US007322662B2

(12) United States Patent
Bich et al.

(10) Patent No.: US 7,322,662 B2
(45) Date of Patent: Jan. 29, 2008

(54) LIQUID-JET WRITING INSTRUMENT

(75) Inventors: Xavier Bich, Neuilly sur Seine (FR); Kurt Rath, Neuilly sur Seine (FR); Alain Rosenzweig, Saint Maur des Fosses (FR)

(73) Assignee: Societe BIC, Clichy (FR)

( * ) Notice: Subject to any disclaimer, the term of this patent is extended or adjusted under 35 U.S.C. 154(b) by 405 days.

(21) Appl. No.: 11/015,286

(22) Filed: Dec. 16, 2004

(65) Prior Publication Data

US 2005/0206628 A1 Sep. 22, 2005

(51) Int. Cl.
*B41J 25/308* (2006.01)

(52) U.S. Cl. ..... 347/8; 347/107; 347/109

(58) Field of Classification Search ..... 347/8, 347/107, 109, 5, 9, 108; 400/88
See application file for complete search history.

(56) References Cited

U.S. PATENT DOCUMENTS 5,501,535 A * 3/1996 Hastings et al. ..... 400/88
5,757,498 A 5/1998 Klein et al.
6,550,997 B1 4/2003 King et al.
6,846,077 B2 * 1/2005 Bich et al. ..... 347/109

FOREIGN PATENT DOCUMENTS

JP 10035025 2/1998

OTHER PUBLICATIONS

Search Report for French Application FR 0315081.

* cited by examiner

*Primary Examiner*—Lam Son Nguyen
(74) *Attorney, Agent, or Firm*—Jones Day

(57) ABSTRACT

A writing instrument comprising a liquid spray head serving to spray liquid onto a medium from a distance, and a processor unit serving to activate the spray head. The instrument further comprises measurement means for measuring the distance between the spray head and the medium, and holding detector means for detecting that the instrument is being held by the user, the processor unit being adapted to activate the liquid spray head when firstly the measurement means determine that the distance between the spray head and the medium is less than a predetermined maximum value, and when secondly the holding detector means detect that the instrument being held by the user.

9 Claims, 3 Drawing Sheets

LIQUID-JET WRITING INSTRUMENT

FIELD OF THE INVENTION

The present invention relates to writing instruments that spray jets of a liquid such as ink.

ART PRIOR TO THE INVENTION

More particularly, among such writing instruments, the invention relates to those which comprise a substantially tubular element that extends between a first end and a second end and that is designed to be held by a user, said tubular element containing:

a reservoir of liquid;

a liquid spray system comprising a liquid spray head connected to the reservoir of liquid, the spray head being designed to spray the liquid onto a medium from a distance; and a processor unit serving to activate the liquid spray system so as to enable the spray head to spray the liquid onto the medium from a distance.

In known writing instruments of this type, the tubular element is generally provided with a feeler having a first end serving to come into contact with the medium during writing, and a second end connected to a detector mechanism for detecting the movements of the feeler in contact with the medium. That detector mechanism is connected to the processor unit in order to enable the liquid spray system to be activated. Thus, when the user is holding the writing instrument in the hand and when said user brings it towards the medium, the feeler comes into contact with the surface of the medium, thereby enabling the detector mechanism to send a signal to the processor unit in order to activate the spraying of the liquid.

Therefore, although the writing head, namely the liquid spray head, no longer needs to be in contact with the medium, it is however essential for the feeler of the writing instrument to be in contact with the medium in order to start spraying the liquid. Bringing the feeler into contact with the medium can, in particular, be uncomfortable for the user when said medium is rough to some extent.

In addition, since the end of the feeler that is in contact with the medium is generally in the vicinity of the point of impact at which the liquid is sprayed onto said medium, major risks exist that said end of the feeler might come into contact with liquid that is not yet dry, thereby smudging it over the medium while the writing instrument is being used normally.

Finally, when the writing instrument is left switched on inadvertently, the feeler which must extend beyond the liquid spray head, can also be subjected to accidental contact, e.g. when the instrument is put away in a pocket or the like, thereby giving rise to undesired spraying of liquid.

OBJECTS AND SUMMARY OF THE INVENTION

An object of the present invention is to mitigate the above-mentioned technical problems by proposing a writing instrument that is reliable and simple, and that offers good writing comfort for the user.

To this end, the invention provides a writing instrument in which the tubular element further contains:

measurement means for acting without physical contact between the writing instrument and the medium to measure the distance between the spray head and the medium, the measurement means being connected to the processor unit; and holding detector means for detecting that the tubular element is being held by the user, the holding detector means being connected to the processor unit;

and in which the processor unit is adapted to activate the liquid spray system when firstly the measurement means determine that the distance between the spray head and the medium is less than a predetermined maximum value, and when secondly the holding detector means detect that the user is holding the tubular element.

By means of these provisions, the writing instrument presents no contact with the medium onto which the liquid is to be sprayed, and the user of the instrument activates the spraying of ink merely by bringing the instrument to a suitable distance from the medium, while holding and pressing normally on the tubular element forming at least a portion of the outside periphery of the writing instrument. Such activation of spraying of liquid can thus be stopped by the user by moving the writing instrument or more exactly the liquid spray head away from the medium. This writing instrument thus makes it possible to cause liquid to be sprayed or to prevent liquid from being sprayed under good conditions which are close to the writing conditions presently experienced with conventional writing instruments such as ball-point pens or felt-tip pens, without however requiring even the slightest physical contact with the writing medium.

In preferred embodiments of the invention, use is further made of one or more of the following provisions:

the processor unit is adapted to activate the liquid spray system when firstly the measurement means determine that the distance between the spray head and the medium lies in the range defined by a predetermined minimum value and by said predetermined maximum value, and when secondly the holding detector means detect that the user is holding the tubular element;

the tubular element further contains an electrical power source and switch means connected to the electrical power source, the switch means being actuatable by the user in order to switch on the liquid spray system, the processor unit, and the measurement means;

the switch means that are actuatable by the user are formed by the holding detector means for detecting that the tubular element is being held by the user;

the switch means that are actuatable by the user further make it possible to switch on the holding detector means for detecting that the tubular element is being held by the user;

the tubular element further contains movement detector means for detecting movement of the tubular element, said movement detector means being connected to the processor unit, and the processor unit is adapted to activate the liquid spray system when:

the measurement means determine that the distance between the spray head and the medium is less than a predetermined maximum value; and the holding detector means detect that the user is holding the tubular element; and the movement detector means detect movement of the tubular element.

the measurement means comprise an optical system serving to measure the distance between the spray head and the medium;

the measurement means comprise an ultrasound acoustic probe serving to measure the distance between the spray head and the medium;

the liquid spray head is provided with at least one nozzle for spraying droplets of liquid, and the spray system further includes an electrical signal generator for generating electrical signals for activating said at least one nozzle of the spray head.

DESCRIPTION OF THE DRAWINGS

Other characteristics and advantages of the invention appear from the following description of embodiments thereof, given by way of non-limiting example, and with reference to the accompanying drawings.

In the drawings.

MORE DETAILED DESCRIPTION

In the various figures, like references designate elements that are identical or similar.

Figure 1:
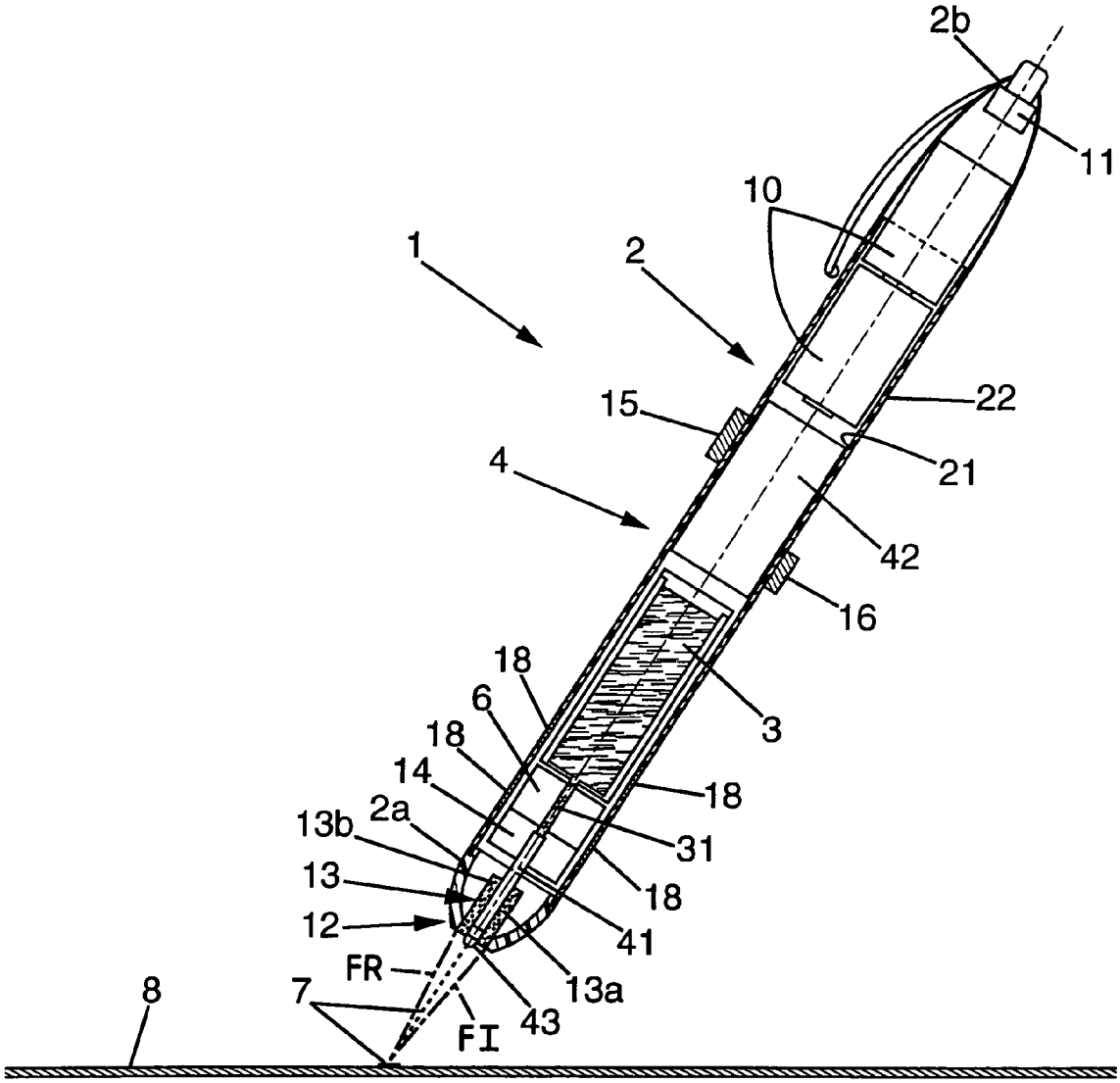
FIG. 1 is a diagrammatic section view of a first embodiment of a writing instrument of the invention.

FIG. 1 shows a writing instrument 1 that includes a substantially tubular element 2 which extends between a first end 2*a* and a second end 2*b*. Said tubular element 2 has an inside wall 21 defining a hollow inside space, and an outside wall 22 designed to be held by a user.

The hollow inside space defined by the inside wall 21 of the tubular element 2 contains a reservoir of liquid 3 and a spray system 4 for spraying said liquid, said spray system being associated directly with the reservoir 3. The reservoir of liquid 3 is removably mounted in the hollow inside space in the tubular element 2 so as to be replaced with another reservoir after said liquid has been used up. Depending on the use to be made of the instrument, the liquid contained in said reservoir can be formed of ink, or of an ink-erasing or ink-masking liquid when the instrument is used as a corrector, or even of adhesive when said instrument is used as an adhesive applicator or spray. The spray system 4 is formed by a liquid spray head 41 connected directly to the reservoir of liquid 3 via a channel 31, and by an electrical signal generator 42 designed to control activation and deactivation of said spray head 41.

In the example considered herein, the spray head 41 is a piezoelectric spray head that includes a spray nozzle 43 disposed at the end 2*a* of the tubular element 2. Said end 2*a* of the tubular element can be constituted by an end-piece fitted directly into the central portion of the tubular element 2 over the inside wall 22 of said central portion. Said end-piece 2*a* presents an end orifice inside which the nozzle 43 of the spray head 41 is disposed. The spray nozzle 43 can be mounted in fixed manner on the end-piece 2*a* or in retractable manner by means of a suitable mechanism so that said nozzle can be housed inside the end-piece, thereby avoiding any risk of said nozzle being damaged while the writing instrument is not being used. In a manner known per se, the spray head 41 includes a piezoelectric element adapted to deform when it is subjected to the electrical signals coming from the generator 42, thereby forming micro-droplets 7 at the spray nozzle 43 that are sprayed onto the medium 8.

The liquid spray system 4 can also be formed by a substrate, e.g. made of glass, on which at least one resistive heater element is mounted, positioned at least one small-size channel containing a small quantity of ink coming from the reservoir 3. Thus, when an electrical signal is generated by the generator 41 on the resistive element, the temperature of said resistive element rises instantaneously, thereby forming a bubble of vapor in the ink, which bubble expels a fine droplet 7 of liquid onto the medium 8.

The liquid spray system 4 can also be formed by at least one cartridge of compressed gas serving to co-operate with an air expansion mechanism and with a cartridge of liquid. Said expansion mechanism can comprise a punch serving to release the gas contained in the cartridge into a pre-chamber under pressure and a plurality of valves in order to control the flow-rate of gas to a nozzle also connected to the reservoir of liquid 3.

The writing instrument also includes a processor unit 6 designed to activate the generator 42 for generating electrical signals (or electrical pulses) in order to enable the spray nozzle 43 of the spray system to spray the droplets 7 onto the medium 8 from a distance. At its end 2*b*, the hollow inside space of the tubular element 2 also contains an electrical power source 10 formed, for example by a battery, or even two batteries, rechargeable or otherwise, making it possible, by means of a switch 11 to switch on the various electrical elements forming the writing instrument.

The end 2*b* of the tubular element 2 can, for example, be in the form of a cap removably mounted on the central portion of said tubular element 2 in order to enable two worn batteries 10 to be replaced with new batteries.

At its end 2*a*, the tubular element 2 also includes measurement means 12 for acting without any physical contact between the writing instrument and the medium 8 to measure the distance between the spray head 41 and the medium 8. More exactly, the measurement means 12 are adapted to measure the distance between the spray nozzle 43 and the medium 8.

In this embodiment, the measurement means 12 are constituted by an optical system 13 which, for example, comprises an infrared light-emitting diode (LED) 13*a* which sends an incident light beam FI towards the medium 8 so as to form a light spot on said medium 8, and a reflected light beam FR. The light beams are then analyzed by a photodiode 13*b* so as to compute the angle of inclination of the incident beam FI relative to the medium 8.

Since the distance between the photodiode 13*b* and the infrared LED 13*a* is known, and since the angle of inclination of the incident light beam FI has been computed, simple trigonometric relationships then suffice to compute the distance between the infrared LED and the medium 8. The photodiode can be formed by a photodiode S6560 sold under the trademark HAMAMATSU.

In another variant embodiment, the optical system 13 can also include emitter means for emitting a conical light beam whose axis of symmetry coincides with the longitudinal axis of the tubular element 2. The optical system then includes a sensor adapted to compute the radius of the light spot formed by the conical beam on the medium 8. Since the radius of the light spot is proportional to the distance between the medium 8 and the emitter means for emitting the conical beam, it is then possible to determine, in linear manner, the distance between the emitter means and the medium. Similarly, if the axis of symmetry of the conical beam is inclined relative to the medium, the light spot formed on the medium is no longer circular but rather elliptical, and the sensor is also adapted to measure the length of the minor axis of the elliptical spot in order to determine the distance between the medium and the emitter means for emitting the conical beam. In which case, and regardless of the inclination of the writing instrument, the length of the minor axis of the elliptical spot is proportional only to the distance between the emitter means and the medium, only the length of the major axis of the elliptical spot being proportional to the inclination of the conical beam.

In a variant embodiment, the measurement means 12 can also be constituted by an ultrasound acoustic probe. In which case, the distance measured between the nozzle 43 and the medium 8 corresponds to the shortest distance between said nozzle 43 and the medium 8, independently of the inclination of the writing instrument relative to the medium 8.

Figure 2:
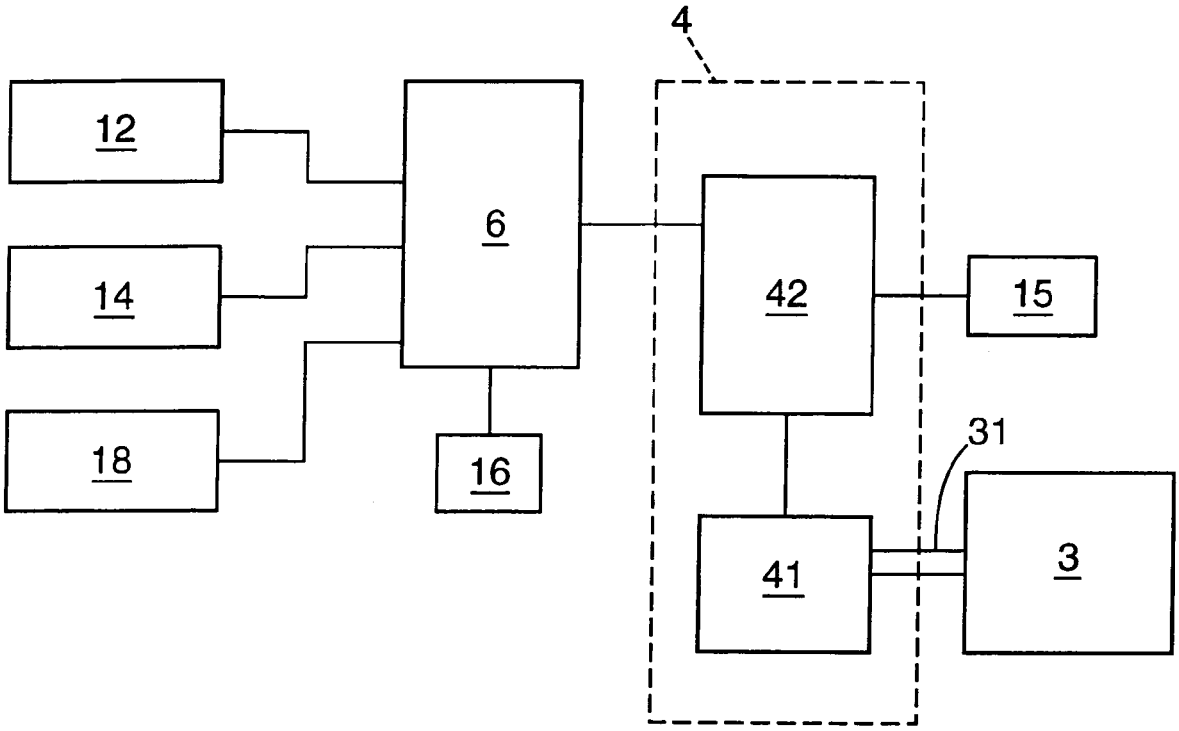
FIG. 2 is a block diagram of the various component elements of the first embodiment of the writing instrument of the invention.

As can be seen with reference to FIGS. 1 and 2, the optical system 13 that forms the measurement means 12 is connected directly to the processor unit 6 which stores in a memory the measurement taken by the optical system 13. The processor unit can also be adapted to cause the optical system 13 to perform measurement operations repeated at determined time intervals. For example, the time intervals could lie in the range 1 millisecond (ms) to 0.1 seconds (s).

The tubular element 2 also includes holding detector means 18 for detecting that the tubular element 2 is being held by the user, said holding detector means also being connected to the processor unit 6.

Said holding detector means 18, which are clearly user-activated, can, for example, be formed by a capacitive sensor or a piezoelectric sensor or a resistive sensor disposed at the outside wall 22 of the tubular element, and designed to detect a pressure whenever the user is holding the instrument.

Thus, with reference to FIGS. 1 and 2, when the user actuates the switch 11, said switch switches on the various electrical elements, namely the measurement means 12, the holding detector means 18 and the liquid spray system 4.

The user then takes hold of the writing instrument so that the capacitive or piezoelectric sensor(s) 18 detect(s) a pressure exerted by the user while said user is moving the writing instrument towards the medium 8. The measurement means 12 also automatically measure the distance between the spray nozzle 43 and the medium 8 and send that measurement to the processor unit 6.

The processor unit 6 is adapted then to activate the liquid spray system 4 and thus to cause droplets 7 to be sprayed onto the medium 8 only when the holding detector means 18 detect a pressure and when the measurement means 12 measure that the distance between the spray nozzle 43 and the medium 8 is less than a predetermined maximum value.

For example, said predetermined maximum value can be about 1 centimeter (cm).

Thus, when the measurement means 12 determine that the distance between the nozzle 43 and the medium 8 is greater than the predetermined maximum value and when the holding detector means detect a pressure on the writing instrument, the processor unit 6 does not activate the spray system and no droplet is sprayed onto the medium 8.

Likewise, the processor unit 6 does not cause droplets to be sprayed when the instrument is not being held by the user even if the nozzle 43 is at a suitable distance from the medium, i.e. at a distance less than the predetermined maximum value.

In a variant embodiment, the processor unit 6 can also be adapted to stop activating the liquid spray system when the spray nozzle 43 is too close to the medium 8 for droplets of liquid 7 to be sprayed properly onto the medium. In which case, the processor unit 6 activates the liquid spray system only if the detector means 18 detect a pressure on the writing instrument, and if the optical system 13 determines that the distance between the spray nozzle 43 and the medium 8 lies in a range of values defined by a predetermined minimum value and by a predetermined maximum value. On its outside wall 22, the tubular element 2 of the writing instrument can also be provided with selection means 15 for selecting the size of the droplets 7 in order to modulate and to modify the thickness of the line that is formed by the succession of droplets deposited on the medium 8. The selection means 15 can, in particular, be in the form of a button having three positions making it possible to obtain three different line thicknesses. The selective-position button 15 is connected directly to the electrical signal generator of the spray system 4 so as to make it possible to vary, in predetermined manner, the frequency and/or the amplitude of the electrical signals sent directly to the liquid spray head 41, thereby causing the size of the droplets and the frequency with which they are sprayed onto the medium 8 to vary proportionally.

The tubular element 2 can also include movement detector means 14. In this embodiment, the movement detector means 14 can be in the form of an accelerometer connected directly to the processor unit 6. Said movement detector means can in particular serve to add an additional condition for making it possible to activate the liquid spray system 4 and thus to activate spraying the droplets 7 onto the medium 8.

Thus, the processor unit 6 is adapted to activate the liquid spray system 4 only when:

- the measurement means 12 measure a distance less than a predetermined maximum value; and
- the holding-pressure detector means 18 detect that the user is holding the tubular element 2; and
- the movement detector means 14 detect movement of the tubular element 2.

Similarly, in order to improve user writing comfort, the processor unit 6 can be adapted to activate communication means 16 designed to emit an alarm signal when firstly the optical system 13 determines that the distance between the ink spray head 41 and the medium 8 is less than a predetermined maximum value, and when secondly the movement detector means 14 do not detect any movement of the spray head 41 relative to the medium 8 for some predetermined time interval. For example, said communication means 16 can be in the form of an emitter for emitting visible light signals or of an emitter for emitting audible sound signals, thereby enabling the user to know when the liquid spray head 41 or more exactly the spray nozzle 43 is at a distance from the medium suitable for enabling the electrical signal generator 42 to be activated, and that movement, even accidental movement, of the writing instrument can cause the spray system 4 to be activated and thus droplets of liquid to be sprayed onto the medium 8.

Similarly, in order to improve user writing comfort, the processor unit 6 can be adapted to activate the communication means 16 in order to emit an alarm signal when the liquid spray system 4 has not been activated for some given time interval (e.g. 30 seconds or 1 minute), and when the measurement means 12 detect that the distance between the spray head 41 and the medium 8 is suitable once again, and when the movement detector means detect movement of the writing instrument again. In which case, the processor unit activates the communication means for, for example, a maximum of two seconds in order to warn the user that the spraying of liquid is imminent, and, after said maximum time interval of two seconds, the processor unit 6 then activates the liquid spray system 4.

Figure 3:
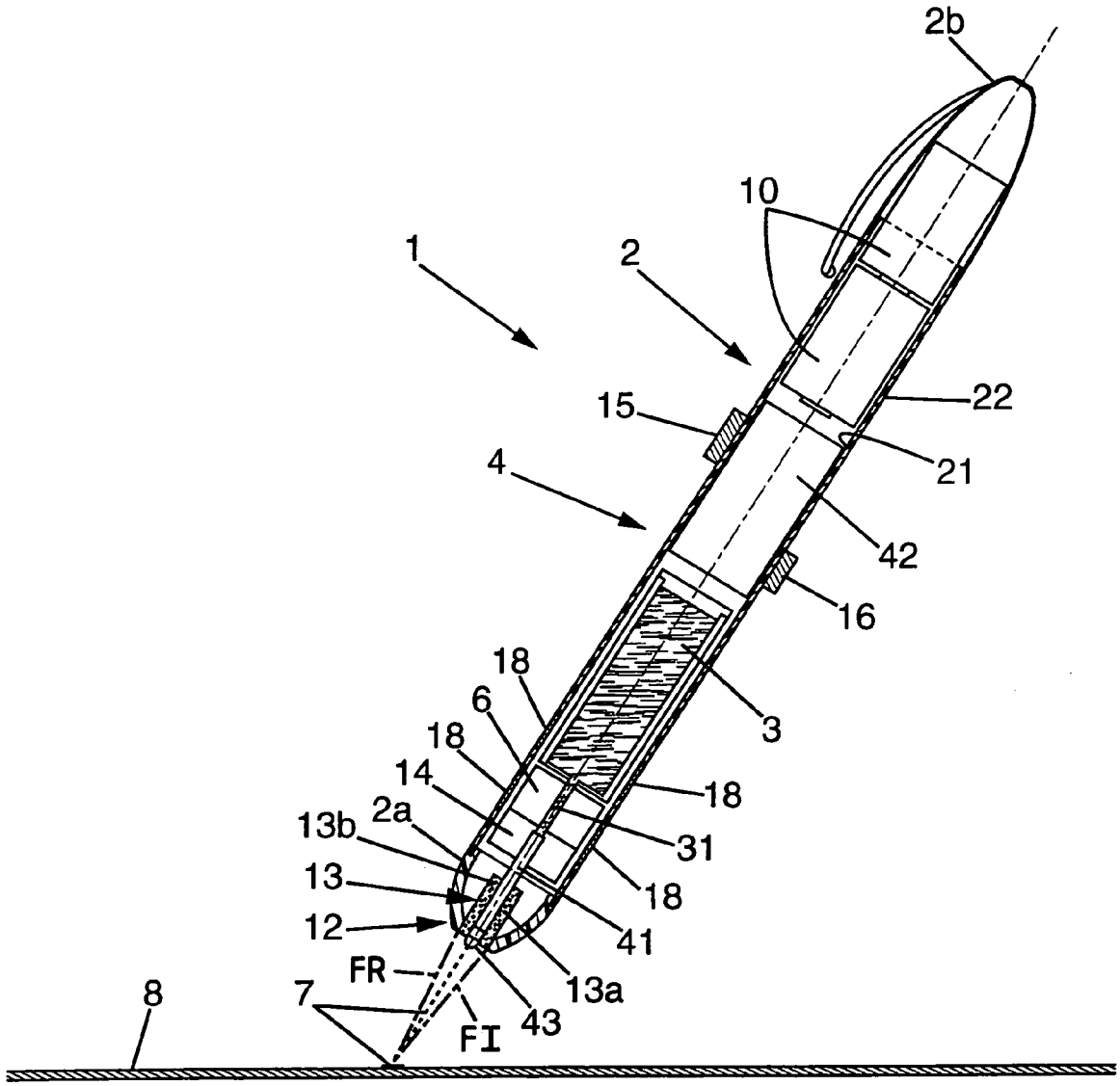
FIG. 3 is a section view of a second embodiment of the writing instrument.

In another embodiment of the invention shown in FIG. 3, the switch button 11 for switching on the various electrical components can be omitted from the end 2*b* of the writing instrument. In which case, the ON/OFF function for the writing instrument is implemented directly by the holding detector means 18. Thus, whenever the user is holding the writing element in a writing position, the fingers of the user exert a pressure on that zone of the outside wall 22 of the tubular element in which the holding-pressure detector means 18 are disposed. The holding-pressure detector means 18 are then adapted to make it possible, via the electrical power source, to switch on the other electrical components integrated in the writing instrument.

The user can then move the spray nozzle 43 towards the medium. The measurement means 12 then automatically measure the distance between the nozzle 43 and the medium, and, whenever said distance is less than the predetermined maximum value, the processor unit 6 automatically activates the spraying of liquid onto the medium 8 from a distance, so long as the distance between the nozzle 43 and the medium 8 is appropriate, and so long as the holding-pressure detector means 18 detect pressure exerted by the user.

Naturally, the embodiment of the writing instrument shown in FIG. 3 can also include movement detector means 14 that are similar to those described above for the embodiment shown in FIG. 1.

The invention claimed is:

1. A writing instrument comprising a substantially tubular element that extends between a first end and a second end and that is designed to be held by a user, said tubular element containing:

a reservoir of liquid;

a liquid spray system comprising a liquid spray head connected to the reservoir of liquid, the spray head being designed to spray the liquid onto a medium from a distance; and a processor unit serving to activate the liquid spray system so as to enable the spray head to spray the liquid onto the medium from a distance, the tubular element further containing:

measurement means for acting without physical contact between the writing instrument and the medium to measure the distance between the spray head and the medium, the measurement means being connected to the processor unit; and holding detector means for detecting that the tubular element is being held by the user, the holding detector means being connected to the processor unit;

and the processor unit is adapted to activate the liquid spray system when firstly the measurement means determine that the distance between the spray head and the medium is less than a predetermined maximum value, and when secondly the holding detector means detect that the user is holding the tubular element.

2. An instrument according to claim 1, in which the processor unit is adapted to activate the liquid spray system when firstly the measurement means determine that the distance between the spray head and the medium lies in the range defined by a predetermined minimum value and by said predetermined maximum value, and when secondly the holding detector means detect that the user is holding the tubular element.

3. An instrument according to claim 1, in which the tubular element further contains an electrical power source and switch means connected to the electrical power source, the switch means being actuatable by the user in order to switch on the liquid spray system, the processor unit, and the measurement means.

4. An instrument according to claim 3, in which the switch means that are actuatable by the user are formed by the holding detector means for detecting that the tubular element is being held by the user.

5. An instrument according to claim 3, in which the switch means that are actuatable by the user further make it possible to switch on the holding detector means for detecting that the tubular element is being held by the user.

6. An instrument according to claim 1, in which the tubular element further contains movement detector means for detecting movement of the tubular element, said movement detector means being connected to the processor unit, and in which the processor unit is adapted to activate the liquid spray system when:

the measurement means determine that the distance between the spray head and the medium is less than a predetermined maximum value; and the holding detector means detect that the user is holding the tubular element; and the movement detector means detect movement of the tubular element.

7. An instrument according to claim 1, in which the measurement means comprise an optical system serving to measure the distance between the spray head and the medium.

8. An instrument according to claim 1, in which the measurement means comprise an ultrasound acoustic probe serving to measure the distance between the spray head and the medium.

9. An instrument according to claim 1, in which the liquid spray head is provided with at least one nozzle for spraying droplets of liquid, and the spray system further includes an electrical signal generator for generating electrical signals for activating said at least one nozzle of the spray head.

* * * * *